United States Patent [19]

Röck et al.

[11] 4,196,943

[45] Apr. 8, 1980

[54] DRAWER GUIDE WITH ROLLER CARRIER

[75] Inventors: Erich Röck, Hochst; Bernhard Mages, Dornbirn, both of Austria

[73] Assignee: Julius Blum Gesellschaft m.b.H., Höchst, Austria

[21] Appl. No.: 902,814

[22] Filed: May 4, 1978

[30] Foreign Application Priority Data

May 13, 1977 [AT] Austria ..... 3434/77

[51] Int. Cl.[2] ..... F16C 21/00

[52] U.S. Cl. ..... 308/3.8; 312/348

[58] Field of Search ..... 308/3.8, 316, 6 R; 312/348

[56] References Cited

U.S. PATENT DOCUMENTS

| | | | |
|---|---|---|---|
| 3,050,348 | 8/1962 | Pipe | 308/3.8 |
| 4,121,876 | 10/1978 | Ratti | 308/3.8 |

*Primary Examiner*—Douglas C. Butler

*Attorney, Agent, or Firm*—Wenderoth, Lind & Ponack

[57] ABSTRACT

A drawer guide assembly includes supporting rails and rollers running on the supporting rails, the rollers being held in a roller-carrier and on the side of the drawer running in a member which is insertable into the sidewall of the drawer.

14 Claims, 12 Drawing Figures

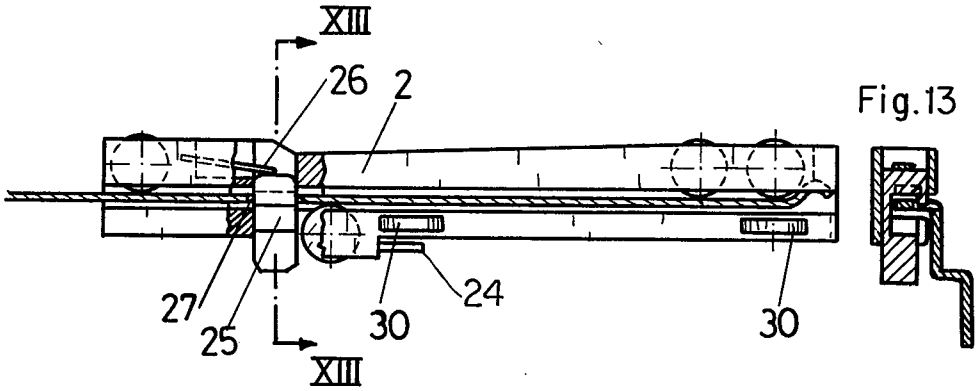
Fig. 11
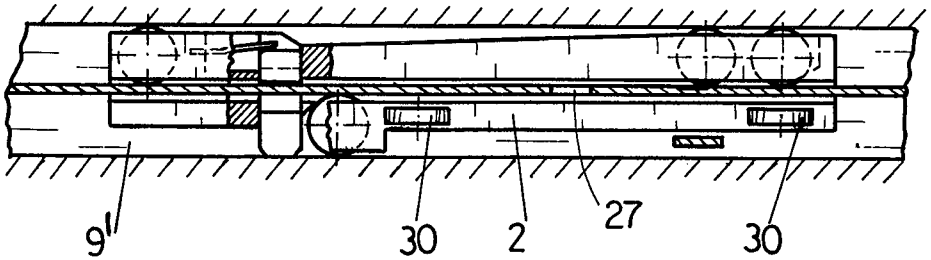
Fig. 12
Fig. 13

DRAWER GUIDE WITH ROLLER CARRIER

BACKGROUND OF THE INVENTION

Field of the Invention

The invention relates to a drawer guide with one supporting rail on either side directed towards the body, each of said supporting rails having a horizontal flange with rollers running on its upper and lower surfaces, the rollers being mounted in a roller-carrier, whereby the weight of the drawer is exclusively transmitted to the supporting rail by means of the rollers.

Description of the Prior Art

Such drawer guides have various advantages compared to drawer guides with rollers directly fixed to the supporting rail and guide rail. First of all, their production is cheaper, and secondly they move as smoothly as differential drawers whereby the drawer cannot, however, be completely pulled out of the body by means of a supporting central rail as in the case of differential drawers if the drawer is to be secured in the body.

The above-mentioned drawer guides are frequently used in furniture production, particularly in kitchen furniture production.

SUMMARY OF THE INVENTION

It is the object of the invention to provide a drawer guide of the above-mentioned kind which can more easily be adapted to the various requirements of furniture production. In the case of drawers which do not have to carry excessively heavy loads, the invention shall make it possible to eliminate a normal structural member, i.e. a running rail, the guide rail in particular, if drawers made of plastics are used, e.g. with side-walls of extruded plastic profile.

According to the invention this is achieved by guiding the rollers in a profiled member in the drawer, the member being insertable into the side-wall of the drawer.

If the drawer has to carry heavy loads the profiled member is a conventional profiled rail which can be inserted into a longitudinal groove in the side-wall of the drawer.

This profiled member can also be a metallic guide rail, a plastic member, or it can be formed directly out of the side-wall of the drawer.

It is a further object of the invention to provide a drawer guide in which the parts of the guide are largely protected against dirt. According to the invention this is achieved by a drawer side-wall having a U-shaped or V-shaped vertical section and a profile being open on the bottom side, and by a profiled member to be inserted into the side-wall, such member having a longitudinal groove for guiding the roller-carrier. The profiled member to be inserted into the side-wall of the drawer is preferably made of plastics and, except for the guiding groove for the roller-carrier, is solidly constructed so that it substantially improves the stability of the side-wall. It is preferably welded to the side-wall, or glued to it, so that it is securely anchored to the side-wall of the drawer in case of great strain. If the front and rear ends of the drawer or the profiled member carrying the roller-carrier are provided with stops for the roller-carrier or with a locking device at the rear end, the roller-carrier is, according to this embodiment, securely supported in the drawer, i.e. the drawer can be lifted from the supporting rail and the roller-carrier remains on a predetermined place in the profiled member of the drawer. It is, for example, provided that the roller-carrier has a locking slide co-acting with a steel spring and engaging in a recess in the profiled member of the drawer when the roller-carrier is locked.

If the locking slide engages in a recess being, for example, disposed at the front end of the horizontal flange of the supporting rail, the roller-carrier remains supported on the supporting rail when the drawer is pulled or lifted from the supporting rail.

In order to improve the gliding characteristics or the path of the roller-carrier, a preferred embodiment of the invention provides that the horizontal flange of the supporting rail is angled at the front end and advantageously also at the rear end.

BRIEF DESCRIPTION OF THE DRAWINGS

In the following the various embodiments of the invention will be described in more detail with reference to the attached drawings, without being limited thereto, and wherein;

FIGS. 11 and 12 are side-views of the roller-carrier, FIG. 11 showing the roller-carrier locked on the supporting rail, and FIG. 12 showing the drawer being pushed in and the roller-carrier being unlocked, and FIG. 13 is a section taken along line XIII—XIII of FIG. 11.

DESCRIPTION OF THE PREFERRED EMBODIMENTS

The drawer guide according to the invention substantially comprises the supporting rail 1 on the side of the body, the roller-carrier 2 and a profiled member forming or replacing the guide rail on the side of the drawer.

Figure 1:
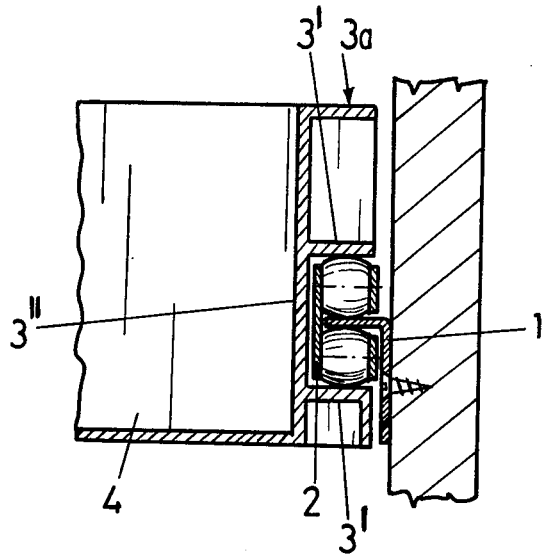
FIG. 1 is a vertical section of a side-wall of a drawer with the drawer guide according to the invention.

In the embodiment according to FIG. 1 the drawer side-wall 3*a* has two flanges 3'. Such flanges together with a vertical flange 3'' delimit the profiled member forming the guide for the roller-carrier 2. Such an embodiment can only be applied if heavy loads do not have to be carried by the drawer.

Figure 2:
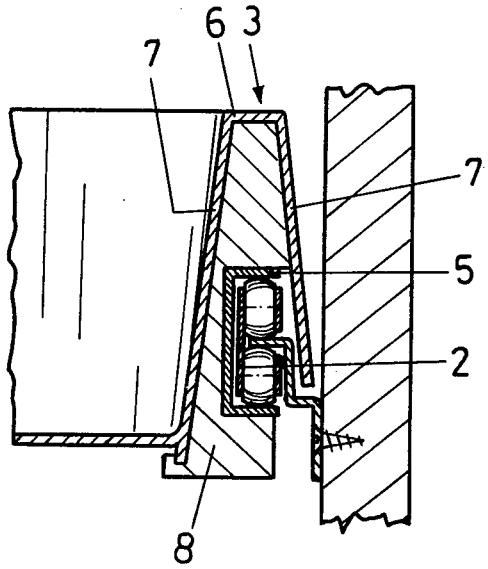
FIGS. 2 and 3 are vertical sections similar to FIG. 1, but of further embodiments of the invention.

If the drawer 4 has to carry heavy loads an additional profiled member 5, such as shown in FIG. 2, formed by a metallic rail can be inserted into the profiled aperture of the drawer side-wall. FIG. 2 shows an embodiment wherein two profiled members are provided. In this embodiment the furniture side-wall 3 has a V-shaped cross-section formed by a covering 6 and two side flanges 7 which diverge in the downward direction. The bottom side of the profile of the drawer side-wall 3 is open. The profiled member 8, preferably made of plastics, is now pushed into the side-wall 3.

Figure 6:
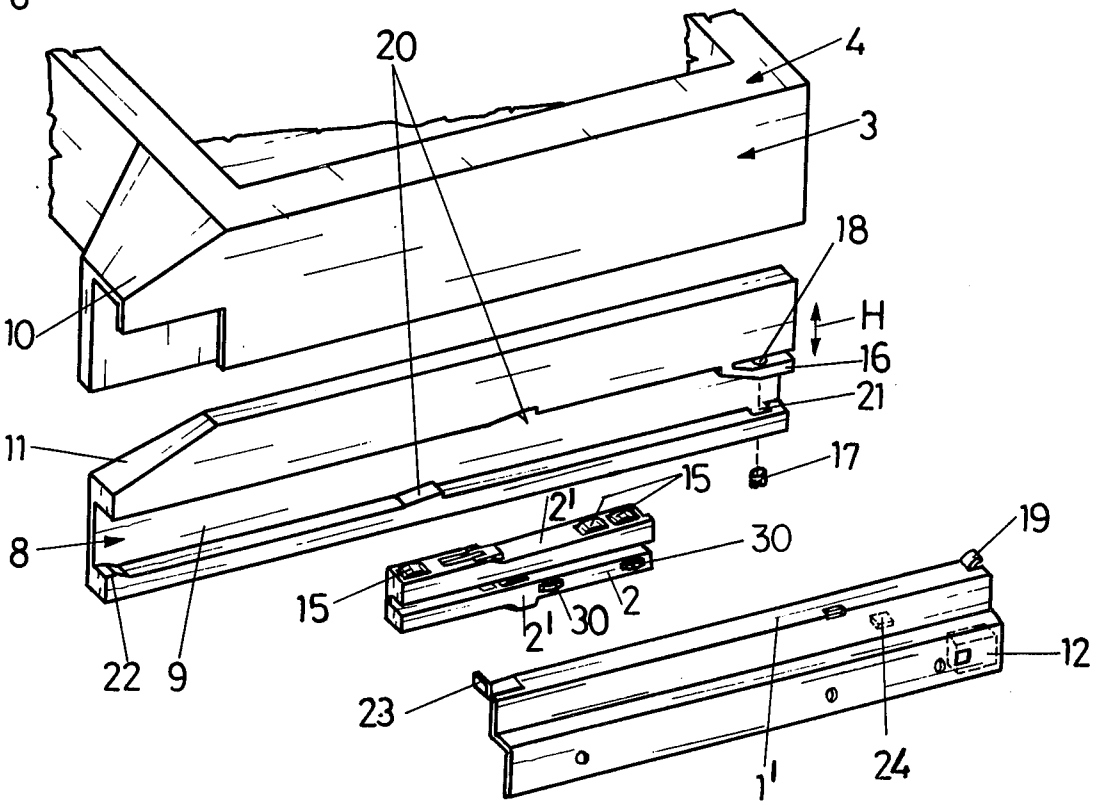
FIG. 6 is a schematic, perspective exploded view of an embodiment of a drawer guide according to the invention, similar to that shown in FIGS. 2–5, but showing additional features.

Profiled member 8 is particularly clearly illustrated in FIG. 6. The profiled member 8 has a longitudinal groove 9 which can take up the roller-carrier 2 directly, as frequently occurs. In the case of excessively heavy loads, longitudinal groove 9 can still be reinforced by an additional metallic profile 5, as shown in FIG. 2.

Figure 3:
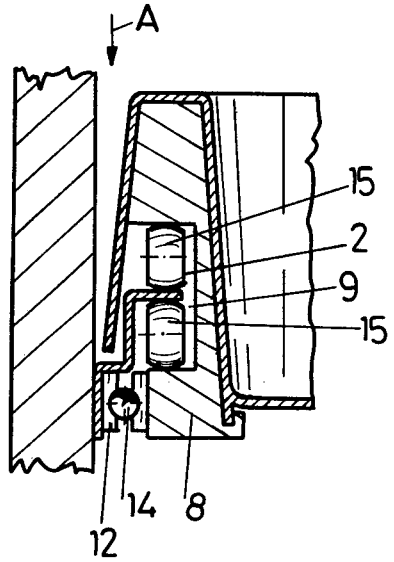
Figure 4:
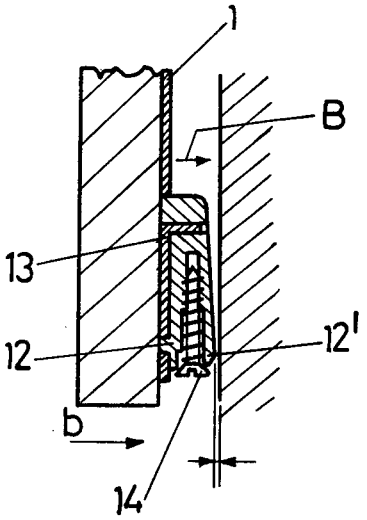
FIGS. 4 and 5 are horizontal section taken in the direction of arrow A of FIG. 3.
Figure 5:
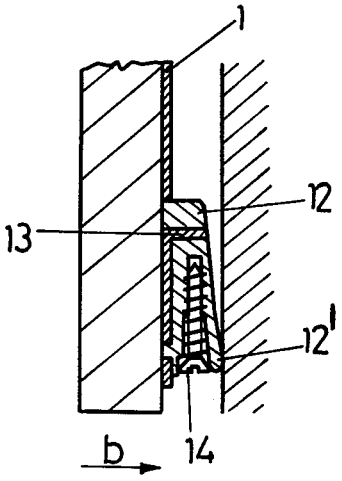

In order to anchor the profiled member 8 in the drawer side-wall 3, member 8 is welded or glued to the drawer side-wall or fastened thereto in a different way. Secure support is also obtained by providing an inclined face 10 at the rear end of the drawer, face 10 covering an inclined face 11 of the profiled member 8 and being a safety device, particularly if the profile of the drawer side-wall is closed at its front side. FIGS 3, 4 and 5 show a side-adjustment device for the drawer 4. Such device comprises a plastic member 12 which is fastened to a flange 13 of the supporting rail 1 and into which a screw 14 can be horizontally screwed, so that it can press a leg 12' of the plastic member 12 in the direction of arrow b, as required.

Leg 12' can rest either directly on the drawer side-wall or on the profiled member 8, as illustrated in FIG. 3. In both cases an optimum alignment of the drawer 4 is achieved.

FIG. 3 shows the profiled member 8 without an additional metallic member, such as 5 shown in FIG. 2. The roller-carrier 2 is directly taken up by the longitudinal groove 9 of the profiled member 8.

It has to be pointed out that up to now it had to be taken into consideration that a plastic member, such as the profiled member 8 or the drawer side-wall 3 (in the embodiment according to FIG. 1), could not support the necessary load. According to the invention it has been found that, when using a soft synthetic material, e.g. soft polyamide, for the roller 15 the running faces of the guide groove 9 are protected and, thus, drawers can be produced which can support sufficient loads in many cases. The rollers could also be made of injection-moulded polyester. FIG. 6 shows the four main elements of the drawer guide according to the invention, except for the side-wall of the body, and including the drawer side-wall 3 which is a plastic profile and which can be made in one piece together with the entire plastic frame of the drawer.

The profiled member 8, which is also made of plastic, and solidly made with the exception of the guide groove 9 for the roller-carrier 2, can be mounted into drawer side-wall 3. The roller-carrier 2 is guided in the guide groove 9 and takes up or supports the horizontal flange, i.e. the running flange 1', of the supporting rail 1 on the side of the body, between the rollers 15, which are mounted in the upper and lower flanges 2' of the roller-carrier. At the front end of the guide groove 9 the profiled member 8 is provided with a height-adjustment device formed by a stop 16 which is a plastic flap injection-moulded to member 8. A screw 17 can be fastened into stop 16, the end of the screw resting against a face 18 of the profiled member 8. By turning the screw 17 the stop 16 can be moved in the direction of double arrow H. When the drawer is pushed in, stop 16 rests on an angled part 19 on the horizontal flange 1' of the supporting rail 1, thus providing the height-adjustment of the drawer 4. The profiled member 8 has inclined faces 20 practically forming the push-in path for the drawer 4, i.e. if the rollers 15 of the roller-carrier 2 lie on inclined faces 20 the drawer 4 rolls into the body of the piece by its own weight. Below the stop 16 the profiled member 8 has a recess 21, which makes it possible to insert a screw driver into the screw 17. The rear end of the groove 9 of the profiled member 8 has a stop 22 for the roller-carrier.

It must also be mentioned that the rear end of the supporting rail 1 also has a stop 23 for the roller-carrier. FIGS. 11 to 13 show an embodiment wherein roller-carrier 2 remains locked in flange 1' of rail 1 when the drawer is pulled out. Adjacent to its front end the supporting rail 1 can advantageously have a stop 24 disposed on the vertical flange of the supporting rail 1, e.g. punched out therefrom. It is the function of stop 24 to correct the position of the roller-carrier 2 when the drawer is pushed in. This can particularly be seen in FIG. 11. When the drawer is pulled out, the roller-carrier rests against the stop 24. When the roller-carrier 2 is locked on the supporting rail 1, a slide 25, which is guided in a roller-carrier 2 and co-acts with a steel spring 26, lies directly above the recess 27 in the horizontal flange 1' of the supporting rail 1 and can engage in it when the drawer 4 is completely pulled out. When the drawer 4 is pushed in again, the slide 25 is pushed up by the lower face 9' of the guide groove 9 and, thus, the locking is released again, as shown in FIG. 12.

Figure 10:
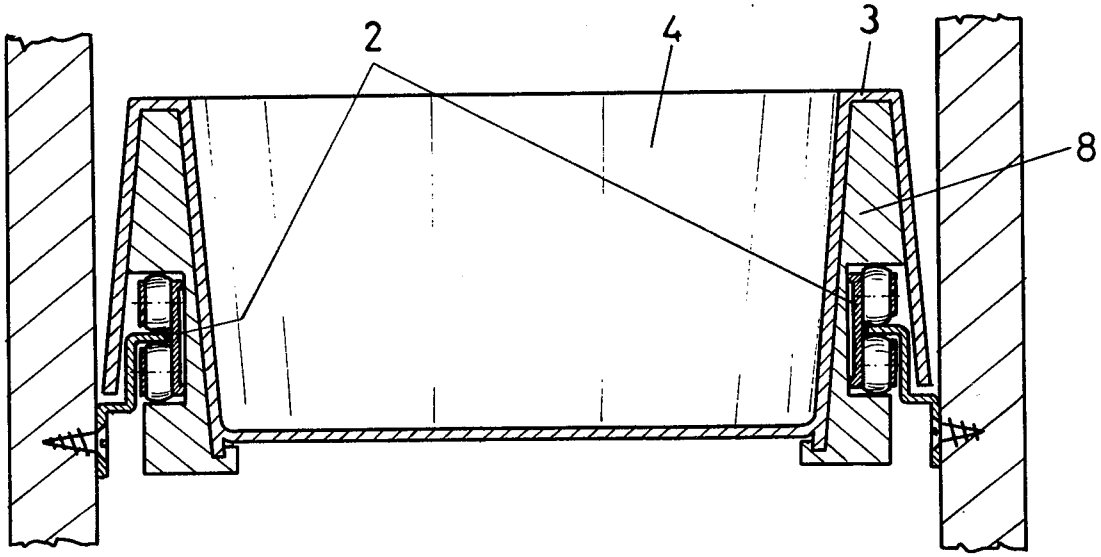
FIG. 10 is a vertical section showing both sides of a drawer equipped with drawer guides according to the invention.

FIG. 10 shows a drawer 4 having on opposite side walls thereof the assembly of the invention.

Figure 9:
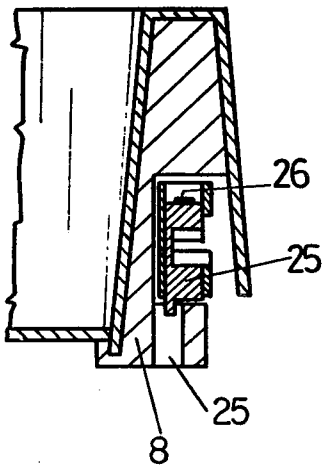
FIG. 9 is a section along line IX—IX of FIG. 7.
Figure 7:
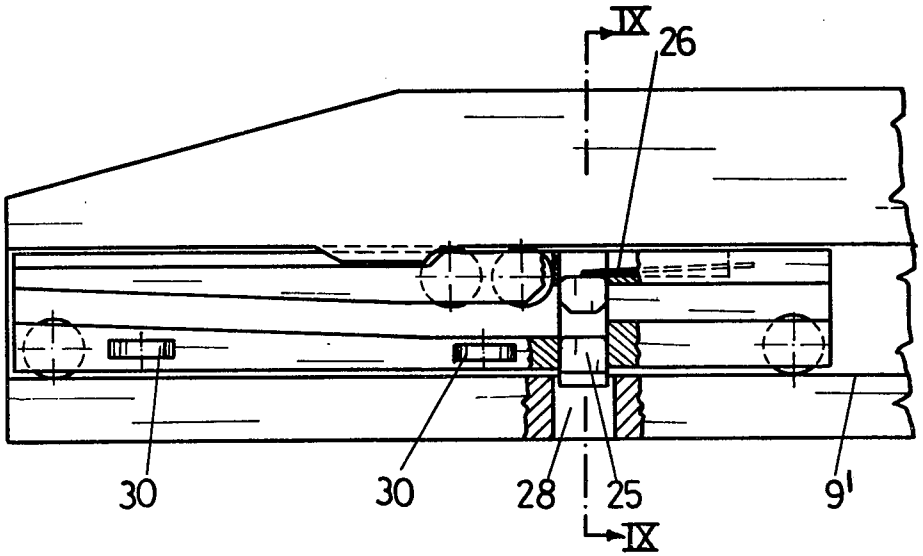
FIGS. 7 and 8 are side-views of the drawer guide, the furniture side-wall not being illustrated.
Figure 8:
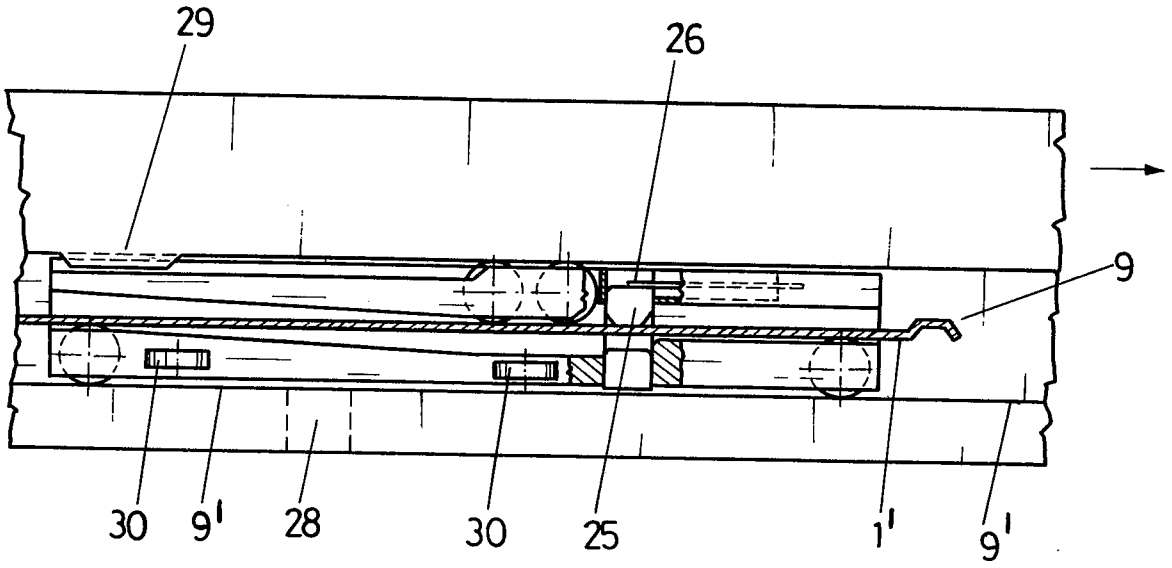

FIGS. 7 to 9 show the embodiment in which the roller-carrier 2 remains locked in the drawer 4 or in the profiled member 8 when the drawer is pulled out of the supporting rail. In this case the profiled member 8 has a recess 28 disposed below the running face 9' for the roller-carrier 2. When in motion, i.e. while the drawer 4 moves on the supporting rail 1, the slide 25 is maintained in the released position by means of the horizontal flange 1' of the supporting rail 1 (FIG. 8). When the drawer is pulled out, the slide 25 is released and is pressed into the recess 28 by the spring 26 (FIGS. 7 and 9). In order to secure the exact position of the roller-carrier 2 the profiled member 8 has a stop 29 which actually fulfils the function of the stop 24 of the supporting rail 1.

Particularly if made of soft plastics, the rollers 15 are solidly constructed and mounted, without axles, by means of plugs being either disposed on the roller-carrier 2 or on the rollers 15.

In the illustrated embodiment, compensating rollers 30 are provided, which are staggered at an angle of 90° with respect of the rollers 15, in order to guarantee particularly smooth running.

We claim:

1. A drawer guide assembly employable on opposite sides of a drawer to mount such drawer for sliding movement into and out of a furniture body, said drawer guide assembly comprising:

a supporting rail attachable to a side of a furniture body, said supporting rail having a substantially horizontal flange extending outwardly from the furniture body side toward a drawer to be mounted in the furniture body;

a substantially horizontal groove provided in a side wall of the drawer, said horizontal flange extending into said groove when the drawer is mounted in the furniture body; and a mobile roller carrier body slidably mounted within said groove, said horizontal flange extending into said body, said body carrying rollers which run on upper and lower surfaces of said horizontal flange and on upper and lower surfaces of said groove during sliding movement of the drawer with respect to the furniture body, whereby the weight of the drawer is directly transferred by said rollers to said horizontal flange.

2. An assembly as claimed in claim 1, wherein said side wall of the drawer includes an elongated recess having an open bottom, and a solid profiled member positioned in said recess, said groove being in said profiled member.

3. An assembly as claimed in claim 2, wherein said side wall has a downwardly extending side flange member substantially closing that portion of said groove above said horizontal flange.

4. An assembly as claimed in claim 2, wherein said profiled member is formed of a plastic material.

5. An assembly as claimed in claim 1, wherein said upper and lower surfaces of said groove have portions inclined downwardly in the direction of sliding movement of the drawer into the furniture body.

6. An assembly as claimed in claim 1, further comprising adjustable stop means positioned in said groove for adjusting the relative height of the drawer when moved fully into the furniture body.

7. An assembly as claimed in claim 1, wherein said supporting rail has on opposite ends thereof stops.

8. An assembly as claimed in claim 1, further comprising means for maintaining said roller carrier body within said groove when the drawer is completely pulled out from the furniture body.

9. An assembly as claimed in claim 8, wherein said means comprises a stop extending downwardly from said upper surface of said groove at a position to abut said roller carrier body adjacent an inner end thereof.

10. An assembly as claimed in claim 9, wherein said means further comprises a slide mounted on said roller carrier body for movement in opposite directions transverse to the longitudinal direction of said groove, a recess forward in said lower surface of said groove, spring means mounted on said roller carrier body for urging said slide into said recess when the drawer has been pulled outwardly of the furniture body by a distance such that said roller carrier body is located outwardly beyond said horizontal flange, and when the drawer is pushed inwardly of the furniture body by a distance such that said horizontal flange extends into said roller carrier body said horizontal flange lifting said slide out of said recess against said spring means.

11. An assembly as claimed in claim 1, further comprising means for maintaining said roller carrier body locked on said horizontal flange when the drawer is completely pulled out from the furniture body.

12. An assembly as claimed in claim 11, wherein said means comprises a stop extending outwardly from said supporting rail adjacent an outer end thereof, said stop adapted to abut an outer end of said roller carrier body.

13. An assembly as claimed in claim 12, wherein said means further comprises a slide mounted on said roller carrier body for movement in opposite directions transverse to said horizontal flange, a recess formed in said horizontal flange, spring means mounted on said roller carrier body for urging said slide into said recess when the drawer has been pulled outwardly of the furniture body by a distance such that said groove is located outwardly beyond said slide, and when the drawer is pushed inwardly of the furniture body said lower surface of said groove lifting said slide out of said recess against said spring means.

14. An assembly as claimed in claim 1, wherein said rollers are formed of a soft plastic material.

* * * * *